US006360066B1

(12) United States Patent
Kawahito et al.

(10) Patent No.: US 6,360,066 B1
(45) Date of Patent: Mar. 19, 2002

(54) DEVELOPING APPARATUS HAVING STIRRING SHAFTS WITH ELLIPTIC STIRRING VANES

(75) Inventors: Hiroshi Kawahito, Nara; Keiji Kato, Nara; Toshio Nishino, Nara; Yasuyuki Ishiguro, Higashiosaka; Jun Yamaguchi, Ikoma; Tsutomu Nagata, Hirakata, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/717,310

(22) Filed: Nov. 22, 2000

(30) Foreign Application Priority Data

Nov. 24, 1999 (JP) ..... 11-333365

(51) Int. Cl.[7] ..... G03G 15/08
(52) U.S. Cl. ..... 399/254; 399/256
(58) Field of Search ..... 399/254, 256

(56) References Cited

U.S. PATENT DOCUMENTS 4,324,483 A * 4/1982 Tagawa et al. ..... 399/256
5,264,900 A * 11/1993 Momiyama et al. ..... 399/256
5,510,882 A * 4/1996 Kikuta et al. ..... 399/257
2001/0008591 A1 * 7/2001 Kaneshige et al. ..... 399/258

FOREIGN PATENT DOCUMENTS

| | | | |
|---|---|---|---|
| JP | 59-100472 | * | 6/1984 |
| JP | 06089061 | | 3/1994 |
| JP | 07168431 | | 7/1995 |
| JP | 08095359 | | 1/1996 |
| JP | 09106154 | | 4/1997 |
| JP | 11202626 | * | 7/1999 |

* cited by examiner

*Primary Examiner*—Quna M. Grainger

(57) ABSTRACT

A developing apparatus is equipped with a development casing, a development roller, and developer stirring shafts that rotate together with the development roller. In this developing apparatus, the developer stirring shafts are disposed adjacent to each other and are also disposed substantially in parallel with the development roller. Each developer stirring shaft has a rotational axis that rotates together with the development roller and has a plurality of stirring vanes of an approximately elliptic shape laid out at a predetermined angle with respect to the rotational axis. The rotational axis is provided substantially in parallel with the development roller. The stirring vanes are disposed substantially in parallel with each other, with the opposing stirring vanes between the adjacent developer stirring shafts having mutually different installation positions in the axial direction.

8 Claims, 11 Drawing Sheets

DEVELOPING APPARATUS HAVING STIRRING SHAFTS WITH ELLIPTIC STIRRING VANES

BACKGROUND OF THE INVENTION

1. Field of the Invention

The present invention relates to a developing apparatus, and more particularly, to a developing apparatus for an image formation apparatus such as a copying unit, a printer, a facsimile unit, etc.

2. Description of the Prior Art

Conventionally, as a developing apparatus that is generally used for an image formation apparatus, there has been known a developing apparatus of the type that has a development roller, a developer restricting member, and a plurality of developer stirring shafts within the development casing.

As the developer stirring shafts disposed within the developing apparatus, there have been widely employed developer stirring shafts that have approximately elliptic stirring vanes (elliptic vanes) formed on the rotational axis or that have a screw-shaped spiral vane formed on the rotational axis.

For example, some developing apparatuses have a structure that a plurality of developer stirring shafts 1 are disposed adjacently in parallel with each other, each developer stirring shaft 1 having a plurality of elliptic vanes 2 installed on the slant at a predetermined angle on a rotational axis 3, as shown in FIGS. 1A and 1B.

Some other developing apparatuses have a structure that a plurality of developer stirring shafts are disposed adjacently in parallel with each other, each developer as stirring shaft 10 having a screw-shaped spiral vane 12 installed on a rotation axis 3, as shown in FIG. 2. Some other developing apparatuses have a structure that a plurality of a set of developer stirring shafts 20 and 21 are disposed adjacently in parallel with each other, the two developer stirring shafts 20 and 21 having spiral vanes 22 and 23 respectively having mutually different pitches. Further, some other developing apparatuses have a structure that a plurality of a set of developer stirring shafts are configured to oppose with each other so that pitches of spiral vanes of developer stirring shafts are shifted one-half pitch with respect to each other.

According to the structure of the developer stirring shafts having elliptic vanes formed on the rotational axis, the distribution of a developer becomes dense at portions where tip portions of the stirring vanes on the stirring shafts oppose with each other. However, at other portions, the shafts oppose with each other, and therefore, the distribution of the developer becomes coarse. As a result, uneven stirring of the developer tends to be emphasized.

Therefore, when the developer stirring shafts within the development casing have all the same shapes, the developer may be maldistributed at only one side within the development casing depending on the combination of the rotational direction. Thus, there has been a problem that the distribution of the developer is influenced by tilt of the development casing.

Further, as the developer conveying force is strong in the radial direction of the developer stirring shafts, some portion of the developer is supplied to the developing section without obtaining a sufficient stirring period within the development casing. Therefore, there has been a problem that this becomes a cause of a defect in the picture quality.

Further, when a plurality of developer stirring shafts 30 having the same shapes are disposed, each developer stirring shaft having elliptic vanes 32 formed in the same pitches, as shown in FIG. 4A and FIG. 4B, the tip portions of the elliptic vanes oppose with each other. At these portions where the tip portions opposes with each other, the developer is stirred strongly, and the conveying force of the developer becomes strong. On the other hand, at portions between the elliptic vanes, that is, at portions where the rotational shafts oppose with each other, the developer is stirred weakly, and the conveying force of the developer becomes weak.

Therefore, when the developer stirring shafts are disposed in such a way that the tip portions of the elliptic vanes coincide with each other between the adjacent developer stirring shafts, the stirring of the developer emphasizes the peak and bottom at the interface of the developer. As a result, uneven stirring of the developer tends become significant, due to occurrence of dense distribution portions and coarse distribution portions of the developer.

Further, when the machine is placed at a slanted position, the distribution of the developer becomes uneven and the developer is maldistributed at one end portion within the development casing. In this case, when the side at which the developer is shifted and the direction to which the developer is conveyed in the axial direction of the developer stirring shafts are the same, there is a problem that the maldistribution of the developer becomes more significant.

On the other hand, in the case of the structure of the developer stirring shafts that have screw-shaped spiral vanes installed on the rotation axes, the developer conveying force in the axial direction is secured. However, there has been a problem that the developer conveying force in the radial direction is inadequate. Further, since the developer conveying force in the axial direction is strong, stagnation of the developer and pressure increase thereof may be caused at the end portions in the conveying direction. Thus, the developer is subjected to a stress. Then, the developer may enter bearing portion which is disposed at the end portions of the conveying direction. As a result there has been a problem that the rotational shafts are blocked by the developer. Meanwhile, in the case of the structure of the developer stirring shafts that have spiral vanes of different pitches installed on the rotational axes, there has been a further problem that the shapes of the parts of the stirring shafts become complex.

In order to improve the stirring and the conveying performance of the developer in the developing apparatus having the above-described conventional structures, there have been the following proposals. In the case of the structure of the developer stirring shafts having elliptic vanes formed on the rotational axes, as disclosed in Japanese Patent Application Laid-open Hei 6 No. 89061 there has been proposed the following structure. That is to say, the developer stirring shafts have two spiral vanes of different pitches, with different external diameters, the external diameter becoming gradually larger toward one direction, or further having one stirring shafts installed with an angle.

Further, there has been proposed a structure of developer stirring shafts having a plurality of elliptic disks installed on the stirring shafts, with brushes provided uniformly between the disks, as disclosed in Japanese Patent Application Laid-open Hei 7 No. 168431.

Further, there has been proposed the following structure of developer stirring shafts, as disclosed in Japanese Patent Application Laid-open Hei 8 No. 95359. That is to say, developer stirring shafts are formed in a semi-cylindrical shape, with a plurality of plate-shaped outside-stirring vanes provided on the slant on the external periphery, and with a plurality of plate-shaped inside-stirring vanes provided on the slant on the inner periphery of the semi-cylinders, in the opposite direction to the slanting angle of the outside-stirring vanes. Further, there is provided a structure of these developer stirring shafts having their flat portions fixed to oppose with each other, and with the far end of each semi-cylinder cut open to communicate inside of each with.

On the other hand, in the case of the structure of the developer stirring shafts having screw-shaped vanes formed on the rotational axes, there has been proposed the following structure, as disclosed in Japanese Patent Application Laid-open Hei 9 No. 106154. The developer stirring shafts have a plurality of stirring vane shafts, with winding directions of spiral vanes at one side formed reversed to those of spiral vanes at the other side with the center portion of each rotational axis as the boundary. Based on this structure, the developer is stirred by combining an arrangement that the toner is conveyed from both sides to the center portion, and an arrangement that the toner is conveyed from the center to both sides, depending on the rotational directions of the developer stirring shafts.

In recent years, along with the increasing demand for a more compact image formation apparatus, the reduction in the height (depth) of the casing of a developing apparatus has been strongly demanded from the viewpoint of space saving. Due to the constraint of the installation inside the developing apparatus, the casing is expanded to the lateral direction in order to secure a necessary volume of a developer. Alternatively, the size of developer stirring shafts is reduced, or pluralization of developer stirring shafts is enhanced.

However, when the developing apparatus is formed in a small height, there is a problem that the performance becomes influenced due to the slanting, and an influence of uneven stirring tends to occur. Further, there has been a problem that the conveying and the stirring performance of the developer are lowered.

Further, all the structures disclosed in the above publications are designed for application to the conventional developing apparatuses having a general depth of the development casing, and are not designed for the above-described developing apparatus having a small height. Therefore, the developing apparatus having a small height are easily affected by environmental disturbances, and cannot provide a stable supply of the developer to the development roller. Thus, there has been a problem that it is not possible to avoid a reduction in the conveying performance and the stirring performance of the developer.

SUMMARY OF THE INVENTION

The present invention has been made in view of the above-described conventional problems. It is, therefore, an object of the present invention to provide a developing apparatus that uses developer stirring shafts in a simple structure, that keeps a volume balance of the distribution of a developer in the axial direction within a development casing, that can improve the efficiency of the stirring of the developer without receiving an influence of an inclined disposition of the development casing, and that optimizes the supply of the developer to a development roller.

In order to achieve the above object, the present invention is configured as follows.

According to a first aspect of the present invention, a developing apparatus that is equipped with a development casing that serves as a developing tank by storing developer, a development roller that supplies the developer within the development casing to a developing section, and a plurality of developer stirring shafts that rotate together with the development roller, thereby to stir and convey the developer within the development casing based on the rotation of the developer stirring shafts, and characterized in that the plurality of developer stirring shafts are disposed mutually adjacent to each other and are also disposed substantially in parallel with the development roller, and each developer stirring shaft has a rotational axis that rotates together with the development roller and having a plurality of stirring vanes of an approximately elliptic shape laid out at a predetermined angle with respect to the rotational axis, wherein the stirring vanes being disposed substantially in parallel with each other, with the opposing stirring vanes between the adjacent developer stirring shafts having mutually different installation positions in the axial direction.

Further, according to a second aspect of the present invention, a developing apparatus of the first aspect is further characterized in that the stirring vanes that are adjacent in the axial direction of the rotational axis are disposed with substantially equal intervals.

Further, according to a third aspect of the present invention, a developing apparatus of the first aspect is further characterized in that, between the adjacently disposed developer stirring shafts, the stirring vanes are installed in the axial directions in such a way that the tip portions of the stirring vanes of one developer stirring shaft oppose substantially the center positions of gaps formed between the tip portions of the stirring vanes of the other developer stirring shaft.

Further, according to a fourth aspect of the present invention, a developing apparatus of the first aspect is further characterized in that, between the adjacently disposed developer stirring shafts, the stirring vanes are installed in the axial directions in such a way that the stirring vanes are positioned by sequentially shifting the installation positions by the amount of (the distance between the adjacent stirring vanes/the number of the developer stirring shafts).

Further, according to a fifth aspect of the present invention, a developing apparatus of the first aspect is further characterized in that the developer stirring shafts that are positioned in odd-number rows counted from the development roller are each set to have a number of stirring vanes that is different from the number of stirring vanes of each of developer stirring shafts that are positioned in even-number rows counted from the development roller, and the stirring vanes of the developer stirring shafts that are located at positions in the order of odd numbers of developer stirring shafts counted from the position of the development roller are set to have all the same shapes, and the stirring vanes of the developer stirring shafts that are located at positions in the order of even numbers of developer stirring shafts counted from the position of the development roller are set to have all the same shapes.

Further, according to a sixth aspect of the present invention, a developing apparatus of the first aspect is further characterized in that, between the plurality of developer stirring shafts laid out in parallel with each other, a difference in the moving speeds of the tip portions of the stirring vane is set to within ±20%.

Further, according to a seventh aspect of the present invention, a developing apparatus of the first aspect in further characterized in that, in each of the developer stirring shafts, stirring vanes are disposed symmetrically around a vertical direction with respect to an axial direction with the center of the developer stirring shaft as a boundary, and, between the adjacent developer stirring shafts, the installation positions of the stirring vanes in the axial direction are shifted by half pitch each.

Further, according to an eighth aspect of the present invention, a developing apparatus of the first aspect is further characterized in that in each of the developer stirring shafts, stirring vanes are positioned with gradually decreasing intervals between adjacent stirring vanes starting from the center of the developer stirring shaft as a boundary toward both ends.

According to the above first aspect, the plurality of developer stirring shafts are disposed mutually adjacent to each other and also in parallel with the development roller. Each developer stirring shaft has a plurality of stirring vanes of an approximately elliptic shape laid out at a predetermined angle with respect to the rotational axis. The stirring vanes are disposed substantially in parallel with each other. Further, the opposing stirring vanes between the adjacent developer stirring shafts have mutually different installation positions in the axial direction. Based on this structure, between the adjacent developer stirring shaft, maximum as well as minimum points of stirring and conveying force are not overlapped with each other. Therefore, it is possible to make uniform the force of stirring and conveying the developer in the axial direction of the developer stirring shafts. As a result, it is possible to stabilize the stirring of the developer, and to achieve uniform conveyance of the developer.

Further, according to the second aspect, the developer is disposed uniformly between the stirring vanes. As a result, it is possible to improve the stabilized stirring of the developer, and to improve the uniform conveyance of the developer.

Further, according to the third aspect, the gap portions of the stirring vanes that have weak conveying force of the developer and that are formed by the adjacent stirring vanes oppose the tip portions of the stirring vanes that have strong conveying force of the developer. Therefore, the large conveying force at the tip portions of the stirring vanes of one developer stirring shaft can compensate for the weak conveying force at the gap portions of the stirring vanes of the other developer stirring shaft. As a result, the peak and bottom at the interface of the developer becomes rather insignificant, and it becomes possible to suppress the generation of the uneven stirring during the development.

Further, according to the fourth aspect, it is possible to avoid the overlapping of maximum as well as minimum points of stirring and conveying force, by sequentially shifting the installation positions of the stirring vanes of the adjacent developer stirring shafts. Therefore, it is possible to gradually suppress the fluctuation in the stirring and conveying conditions of the developer depending upon positions where stirring vanes are present or not. As a result, it is possible to suppress the generation of the uneven stirring of the developer.

Further, according to the fifth aspect, even when the number of developer stirring shafts of the developing apparatus is required to be increased or decreased, it is possible to cope with the situation by using the developer stirring shafts of two different kinds of shapes. As a result, it is possible to minimize the number of the kinds of machine parts.

Further, according to the sixth aspect, it is possible to make substantially the same the moving speeds of the tip portions of the stirring vane of each developer stirring shaft. As a result, it is possible to provide a stable supply of the developer necessary for the development to the developing section.

Further, according to the seventh aspect, when the stirring vanes are disposed in symmetry with the center of the developer stirring shaft in the axial direction as a boundary, the developer flows from the center portion to both ends within the development casing. Therefore, it is possible to suppress the maldistribution of the developer. At the same time, the developer is stirred toward both ends of the axial direction of the developer stirring shaft. As a result, it is possible to make uniform the distribution of the developer at both ends.

Further, according to the eighth aspect, as the interval between the stirring vanes becomes smaller toward both ends of the developer stirring shaft, the holding of the developer by the stirring vanes is increased. As a result, there is an effect that there is less influence of the shape of the development casing or the installation inclination.

While the above explains the aspects of the present invention, it is needless to mention that a suitable combination of these aspects belongs to the scope of the present invention.

DESCRIPTION OF THE PREFERRED EMBODIMENTS

Embodiments of the present invention will be explained in detail with reference to the drawings.

Figure 1A:
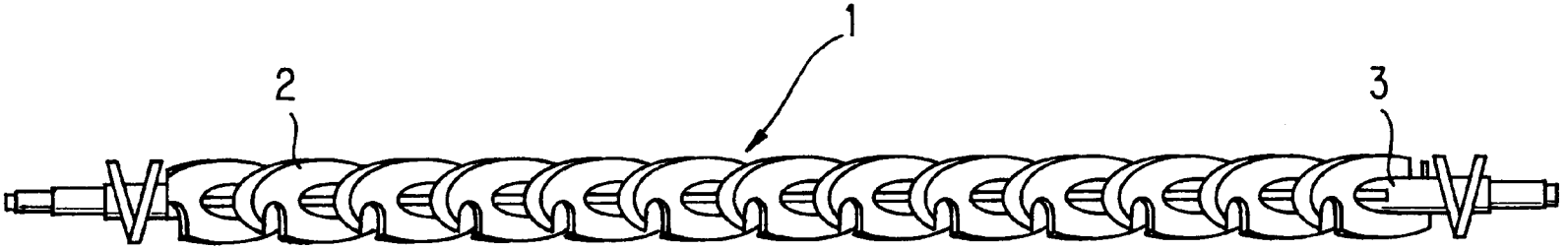
FIG. 1A PRIOR ART
FIG. 1A is an explanatory view showing a structure of a developer stirring shaft according to a conventional example 1.
Figure 1B:
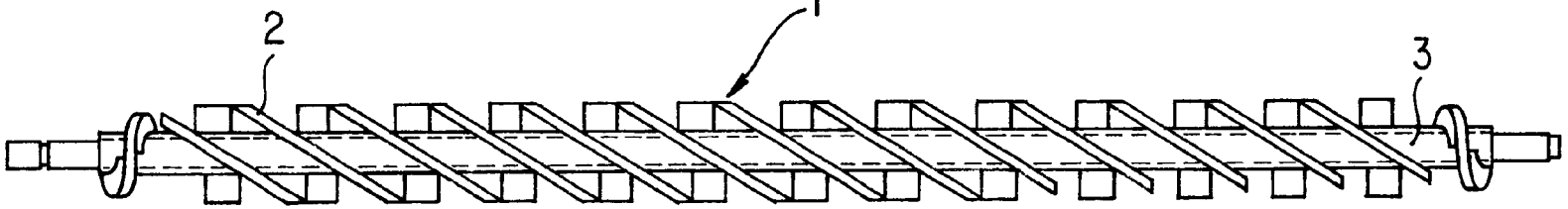
FIG. 1B PRIOR ART
FIG. 1B is an explanatory view showing a state that the developer stirring shaft of the conventional example 1 shown in FIG. 1A is rotated by 90 degrees.
Figure 2:
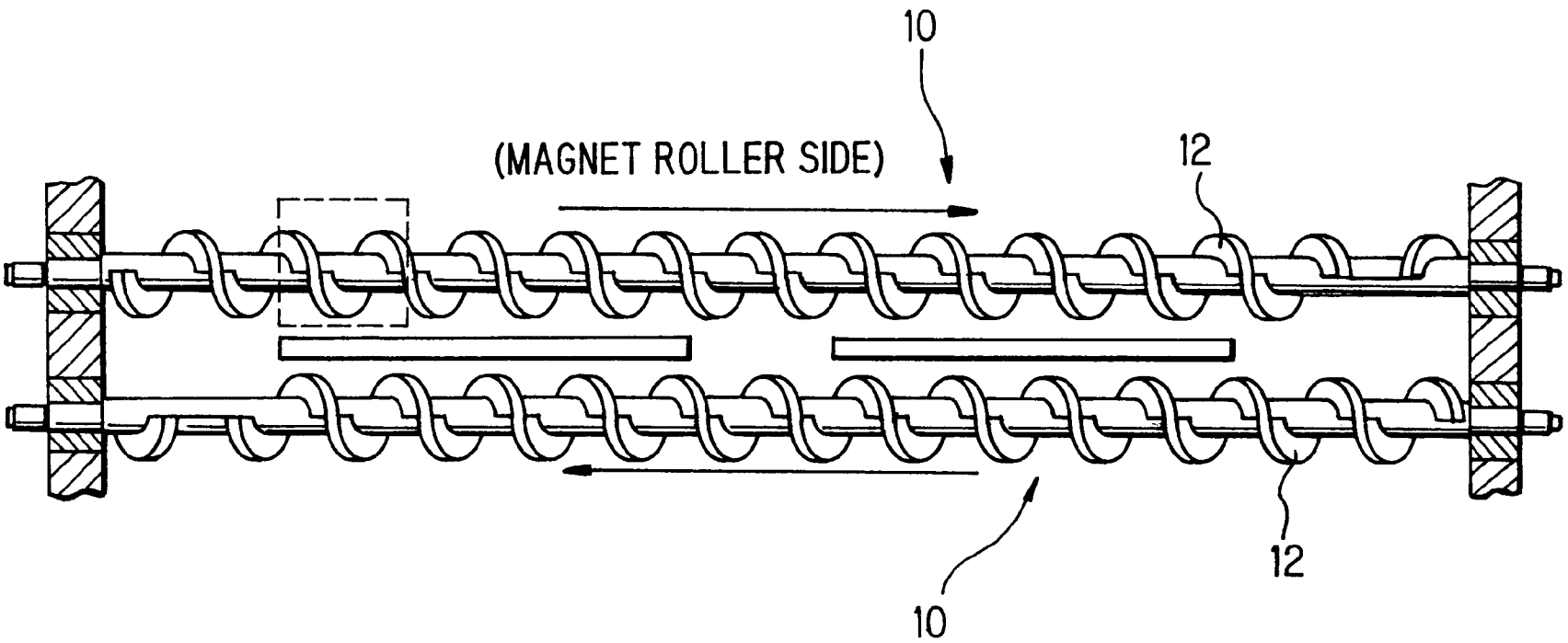
FIG. 2 PRIOR ART
FIG. 2 is an explanatory view showing a structure of developer stirring shafts according to a conventional example 2.
Figure 3:
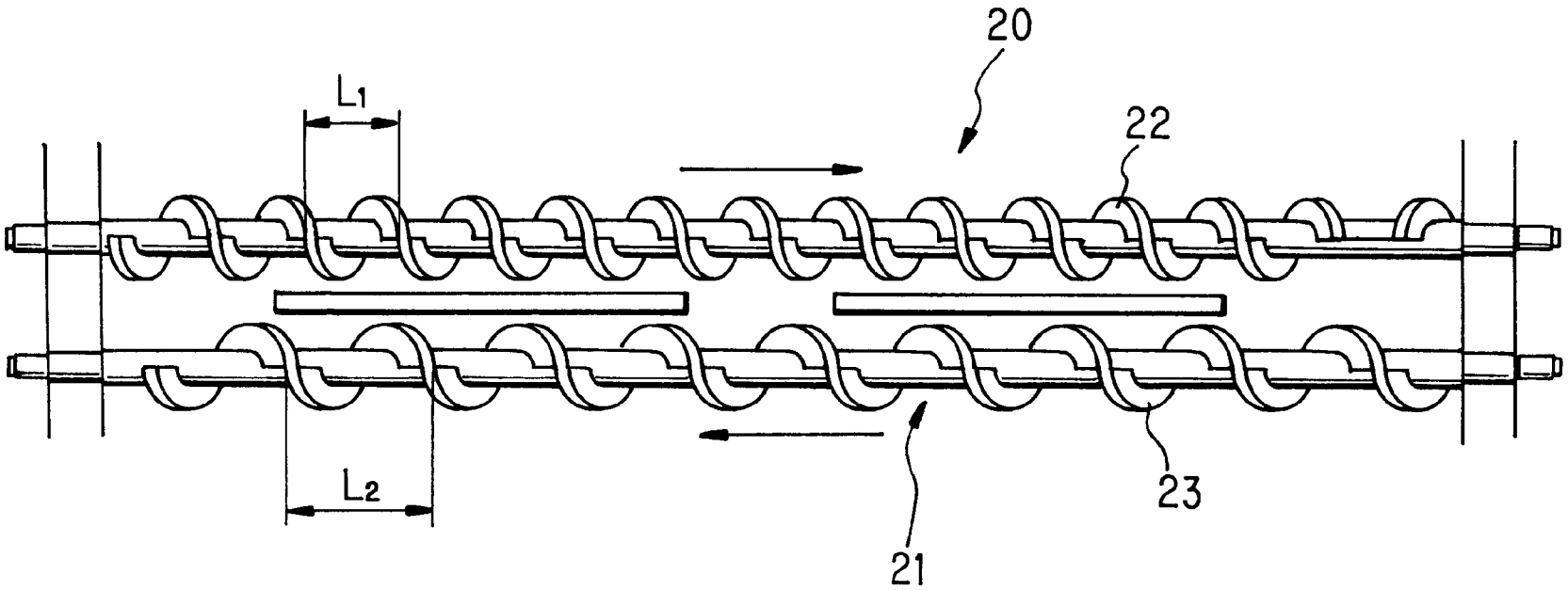
FIG. 3 PRIOR ART
FIG. 3 is an explanatory view showing a structure of developer stirring shafts according to a conventional example 3.
Figure 4A:
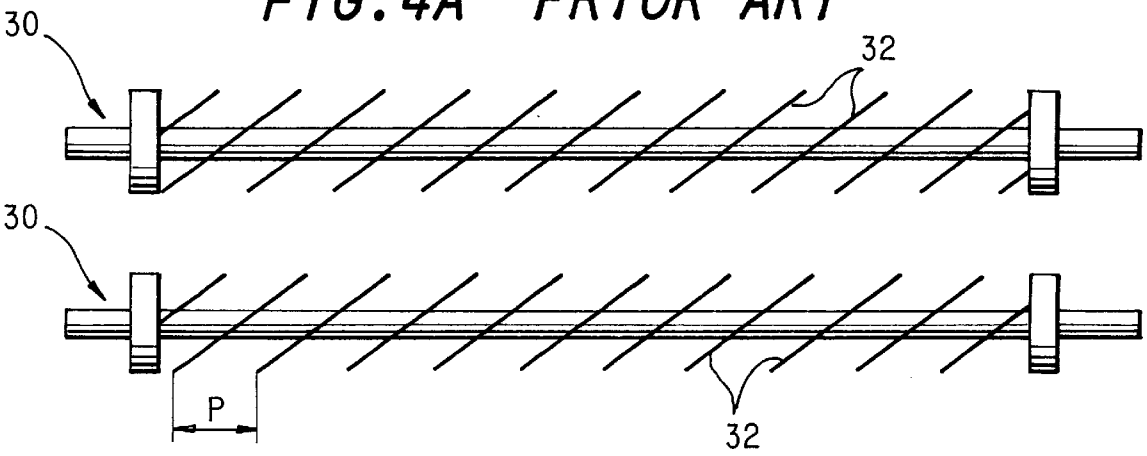
FIG. 4A PRIOR ART
FIG. 4A is a schematic view showing a structure having two conventional developer stirring shafts.
Figure 4B:
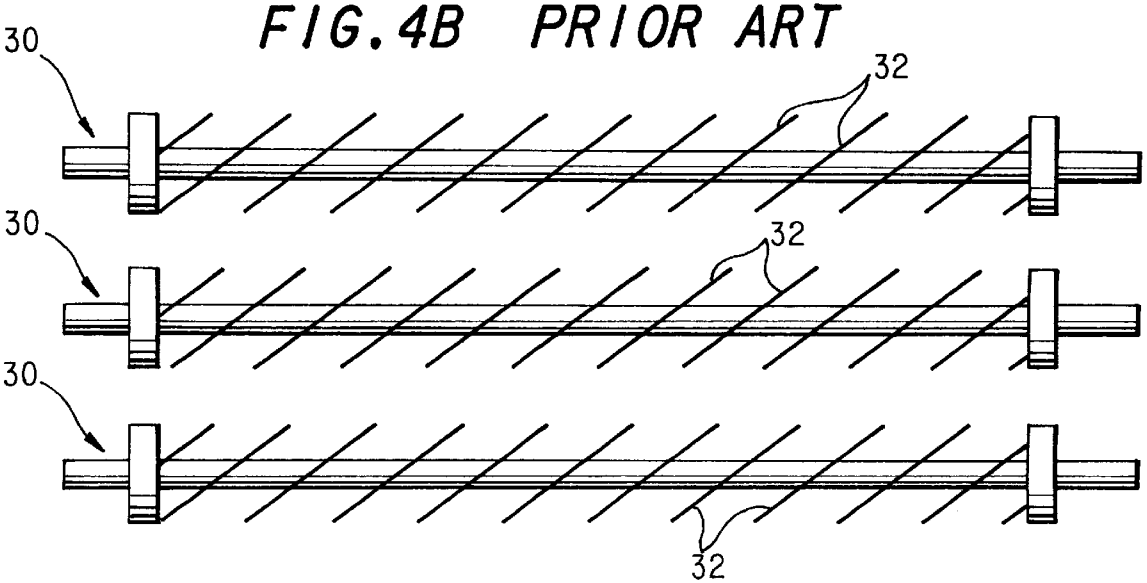
FIG. 4B PRIOR ART
FIG. 4B is a schematic view showing a structure having three conventional developer stirring shafts.
Figure 5:
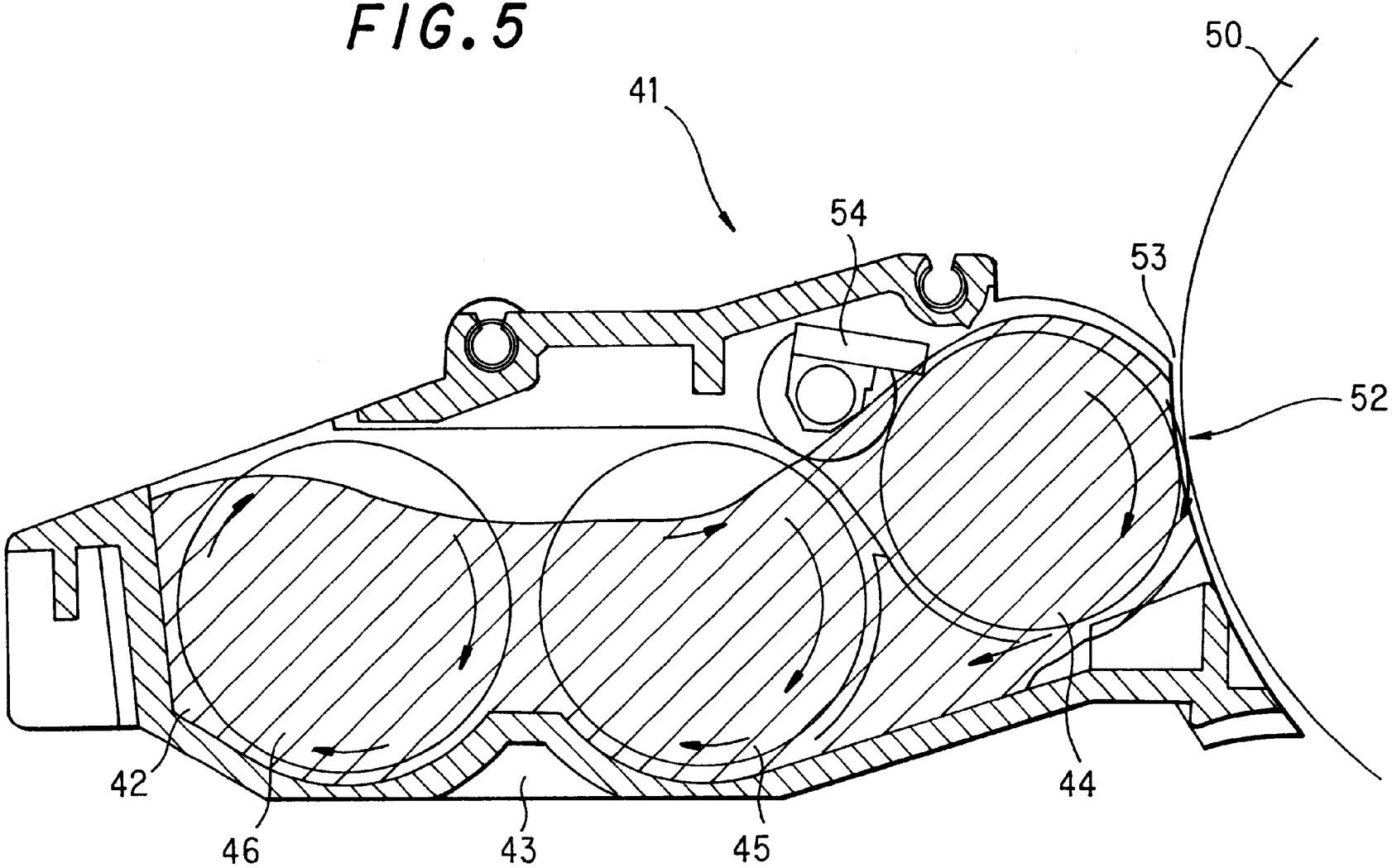
FIG. 5 is a cross-sectional side view showing a structure of a developing apparatus of the first embodiment of the present invention.
Figure 6:
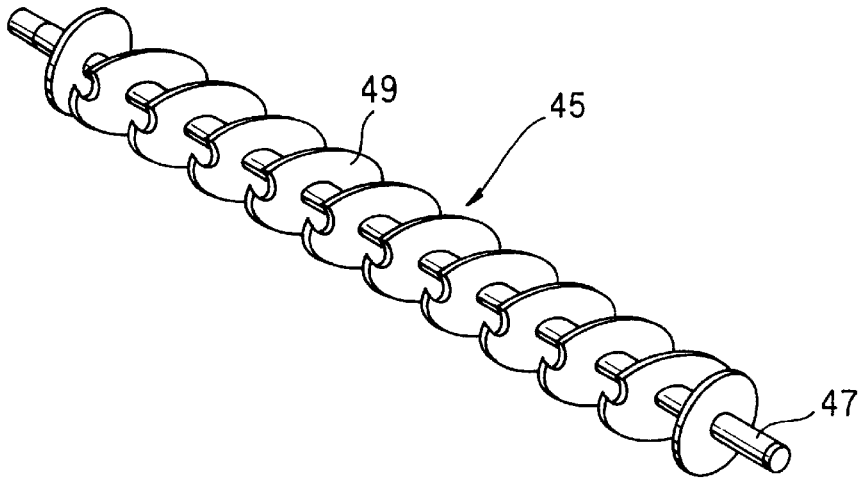
FIG. 6 is a view showing the whole structure of a developer stirring shaft of the first embodiment of the present invention.
Figure 7A:
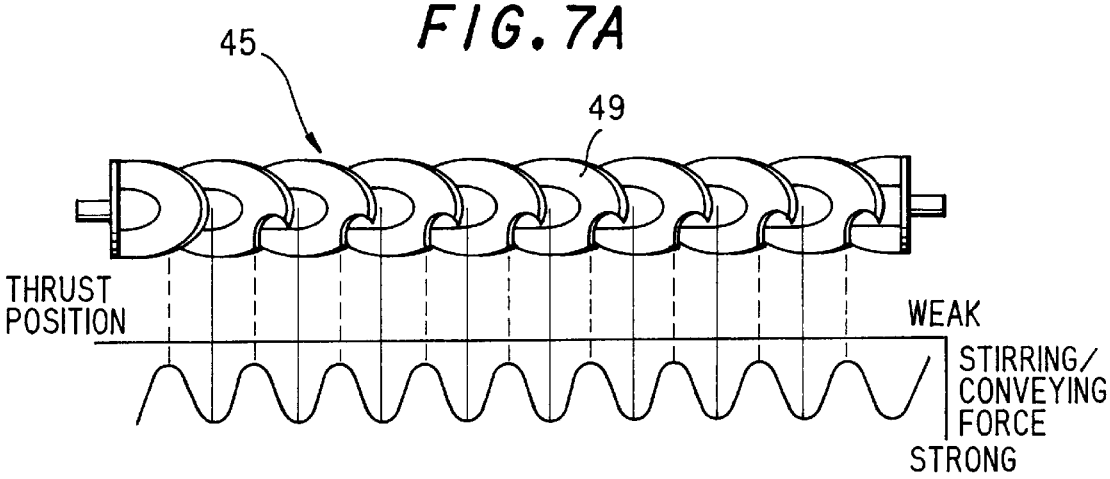
FIG. 7A is an explanatory view qualitatively showing stirring and conveying characteristic of a developer by elliptic vanes.
Figure 7B:
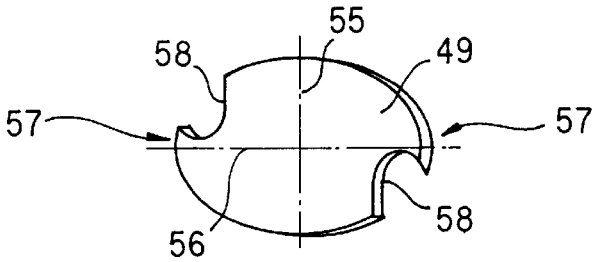
FIG. 7B is an explanatory view showing details of the elliptic vane.
Figure 8A:
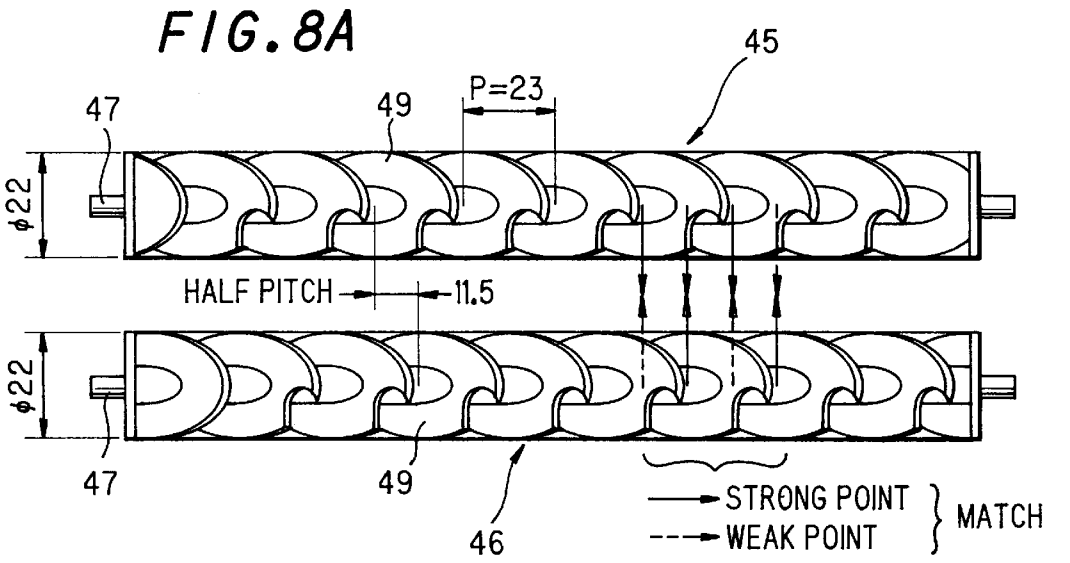
FIG. 8A is an explanatory view showing a structure of the developer stirring shafts of the first embodiment of the present invention.
Figure 8B:
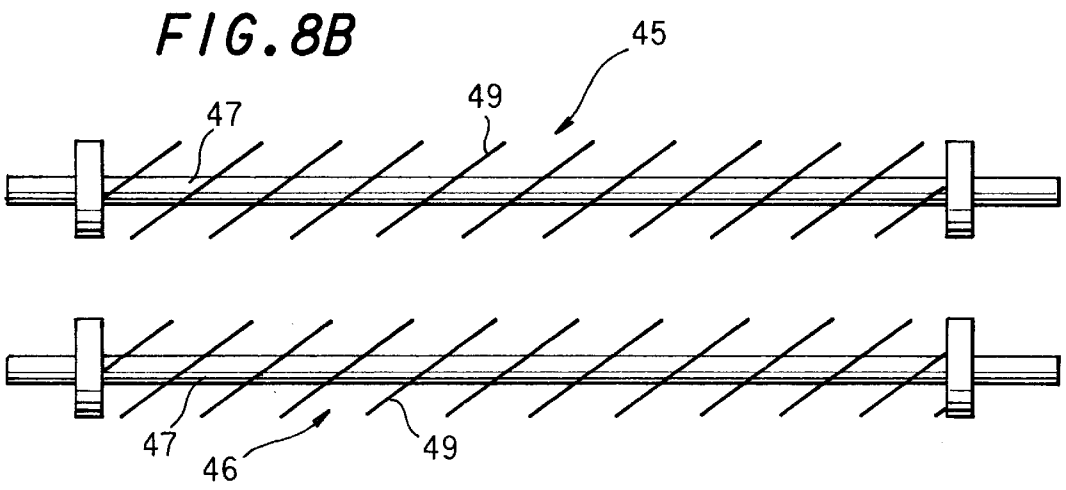
FIG. 8B is a schematic view showing a state that the developer stirring shafts of the first embodiment of the present invention shown in FIG. 8A is rotated by 90 degrees.

FIG. 5 is a cross-sectional side view showing a structure of a developing apparatus of the first embodiment of the present invention, and FIG. 6 is a view showing the whole structure of a developer stirring shaft of the first embodiment. FIG. 7A is an explanatory view qualitatively showing stirring and conveying characteristics of a developer by elliptic vanes, and FIG. 7B is an explanatory view showing details of the elliptic vane. FIG. 8A is an explanatory view showing a structure of the developer stirring shafts of the first embodiment the present invention, and FIG. 8B is a schematic view showing a state that the developer stirring shafts of the first embodiment shown in FIG. 8A is rotated by 90 degrees.

As shown in FIG. 5, a developing apparatus 41 relating to the first embodiment includes a development casing 43 that becomes a developing tank for storing a developer 42, a development roller 44 that supplies the developer 42 within the development casing 43 to a developing section, and a first developer stirring shaft 45 and a second developer stirring shaft 46 that rotate together with the development roller 44. The developing apparatus 41 stirs and conveys the developer within the development casing 43 based on the rotation of these two developer stirring shafts.

The first developer stirring shaft 45 and the second developer stirring shaft 46 are disposed mutually adjacent to each other and are also disposed substantially in parallel with the development roller 44. Each of the first developer stirring shaft 45 and the second developer stirring shaft 46 has a rotational axis 47 that rotates together with the development roller 44 and has a plurality of stirring vanes 49 having an approximately elliptic shape laid out at a predetermined angle with respect to the rotational axis 47. The rotational axis 47 is provided substantially in parallel with the development roller 44. The stirring vanes 49 are disposed substantially in parallel with each other, with the opposing stirring vanes 49 between the adjacent developer stirring shafts having mutually different installation positions in the axial direction.

The development casing 43 has a box-shaped structure, and is disposed close to a cylindrical photo receptor 50 for making the developer 42 sensitive to the light. An aperture 52 is also formed at a position of the development casing 43 that opposes the photo receptor 50. The aperture 52 is formed along a width direction of the photo receptor 50 to have a predetermined uniform gap between the aperture 52 and the photo receptor 50.

Within the development casing 43, there are disposed in a row substantially in parallel with each other the development roller 44, the first developer stirring shaft 45 and the second developer stirring shaft 46 in this order from the photo receptor 50 side.

The development roller 44 is disposed close to the aperture 52, and is also disposed close to the photo receptor 50 substantially in parallel with the photo receptor 50 with a predetermined gap 53 formed between the development roller 44 and the photo receptor 50. Above the gap 53 and between the development roller 44 and the first developer stirring shaft 45, there is provided a developer regulating member 54 close to the development roller 44.

The developer regulating member 54 is disposed close to the outer periphery of the development roller 44 substantially in parallel with the development roller 44 in the axial direction, and regulates the amount of the developer 42 that is held on the outer periphery of the development roller 44 and brought to the photo receptor 50 side along the rotation of the development roller 44.

As shown in FIG. 6, the first developer stirring shaft 45 has a plurality of stirring vanes 49 of an approximately elliptic shape disposed on the rotational axis 47 at equal intervals and at a predetermined angle with respect to the rotational axis 47. As shown in FIG. 6 and FIG. 7A, the stirring vanes 49 are installed on the rotational axis 47 in such a way that short axes 55 are orthogonal with the rotational axis 47 while long axes 56 are inclined to the rotational axis 47.

As shown in FIG. 7B, each stirring vane 49 is formed with two recesses 58 of an approximately semi-circle shape symmetrically at two tip portions 57 of a long axis, with a core line as a center.

As shown in FIG. 8A, the second developer stirring shaft 46 has almost a similar structure to that of the first developer stirring shaft 45. The second developer stirring shaft 46 has a plurality of stirring vanes 49 of an approximately elliptic shape disposed on the rotational axis 47 at equal intervals and at a predetermined angle with respect to the rotational axis 47. At the same time, the stirring vanes 49 of the second developer stirring shaft 46 are installed such that the pitches of these stirring vanes 49 are shifted by one-half pitch from the pitches of the stirring vanes 49 of the adjacent developer stirring shaft 45.

Stirring and conveying characteristics of the developer by the stirring vanes 49 will be explained with reference to the drawings.

FIG. 7A shows stirring and conveying characteristics of the developer 42 by the stirring vanes 49. Positions in the thrust directions are shown in the abscissa, and strength and weakness of the stirring and conveying force are qualitatively shown in the ordinate.

It can be understood from FIG. 7A that the stirring and conveying force becomes strong at a point where the rotational axis 47 crosses the short axis 55 of each stirring vane 49 while the stirring and conveying force becomes weak at a point where the rotation axis 47 crosses the long axis 56 of each stirring vane 49.

The long axis side tip portion 57 of each stirring vane 49 is formed with the recess 58 for making the developer 42 escape. It can also be understood that the stirring and conveying force becomes weak at this recess 58.

Therefore, when the developer stirring shaft having the array of these stirring vanes 49 are rotated, there occurs a uneven strength in the stirring and conveying force in the axial direction as shown in FIG. 7A.

According to the structure of the first embodiment, the stirring vanes 49 of the second developer stirring shaft 46 are installed such that the pitches of these stirring vanes 49 are shifted by one-half pitch from the pitches of the stirring vanes 49 of the adjacent developer stirring shaft 45. Therefore, it is possible to avoid the emphasizing of the peak and bottom due to the overlapping of respective strong points and respective weak points at the interface of the developer 42. Thus, it is possible to suppress the generation of the uneven force of stirring and conveying for the developer, that is, the generation of uneven stirring. As a result, it is possible to improve the uniform distribution of the developer.

Further, as the present embodiment employs the structure of the stirring vanes 49 having an elliptic shape, the conveying force of the developer is excellent in a radial direction orthogonal with the axial direction even when the developing apparatus is a low-height type. Therefore, it is possible to achieve a stable conveying of the developer without an influence of the inclination of the developing apparatus.

In the first embodiment, within the development casing 43, there are disposed two developer stirring shafts, the first developer stirring shaft 45 and the second developer stirring shaft 46, for stirring the developer 42 within the development casing 43 and for conveying the developer 42 to the development roller 44. However, in the present invention, the number of developer stirring shafts is not limited to two, and any plural number is acceptable such as, for example, three or four developer stirring shafts.

Next, a second embodiment of the present invention will be explained with reference to the drawings.

Figure 9A:
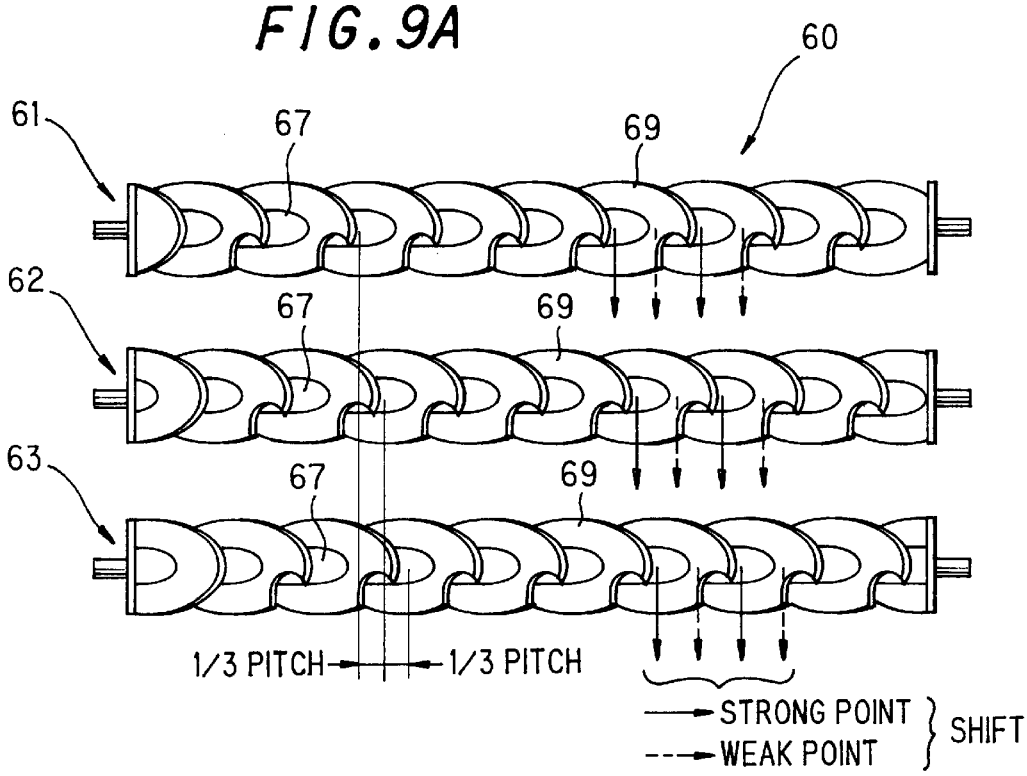
FIG. 9A is an explanatory view showing a structure of developer stirring shafts relating to a second embodiment of the present invention.

FIG. 9A shows a structure of developer stirring shafts having three developer stirring shafts in the developing apparatus.

As shown in FIG. 9A, a developing apparatus 60 relating to the second embodiment has first to third developer stirring shafts 61, 62 and 63. The installation pitches of stirring vanes 69 are mutually shifted by one-third pitch.

According to this structure, like in the first embodiment, it is possible to avoid the emphasizing of the peak and bottom due to the overlapping of respective strong points and respective weak points at the interface of the developer. As a result, it is possible to achieve a stable stirring and conveying of the developer, without emphasizing the peak and bottom of the stirring and conveying force.

Figure 9B:
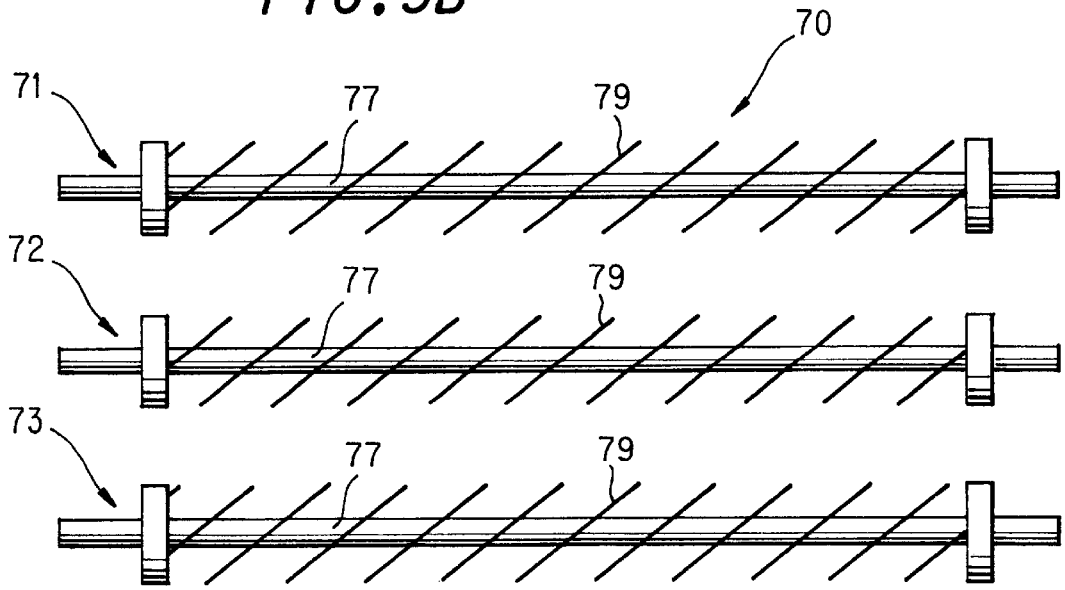
FIG. 9B is a schematic view showing a structure of developer stirring shafts relating to a modification of the second embodiment of the present invention.

FIG. 9B shows a structure of developer stirring shafts relating to a modification of the second embodiment.

FIG. 9B shows a case that three developer stirring shafts are provided. The shaft closely disposed to a development roller (not shown) is designated as the first developer stirring shaft 71, then a second developer stirring shaft 72 and a third developer stirring shaft 73 are sequentially disposed in this order.

The first developer stirring shaft 71 and the second developer stirring shaft 72 are structured such that installation pitches of opposing stirring vanes 79 between these developer stirring shafts are shifted by one-half pitch.

The third developer stirring shaft 73 has exactly the same structure as that of the first developer stirring shaft 71. In other words, only the second developer stirring shaft 72 that is disposed between the first developer stirring shaft 71 and the third developer stirring shaft 73 is structured such that the stirring vanes 79 installed on the rotational axis 77 have pitches that are shifted by one-half pitch from the pitches of the first developer stirring shaft 71 and the second developer stirring shaft 73 respectively.

According to this structure, like in the second embodiment, it is possible to avoid emphasizing of the peak and bottom due to the overlapping of respective strong points and respective weak points at the interface of the developer. As a result, it is possible to achieve a stable stirring and conveying of the developer, without emphasizing the peak and bottom of the stirring and conveying force. Further, as the first developer stirring shaft 71 and the third developer stirring shaft 73 have the same shapes, it is possible to use exactly the same materials for these developer stirring shafts. Therefore, this has an advantage in that the productivity is superior to that of the second embodiment.

A third embodiment relating to the present invention will be explained next with reference to the drawings.

Figure 10A:
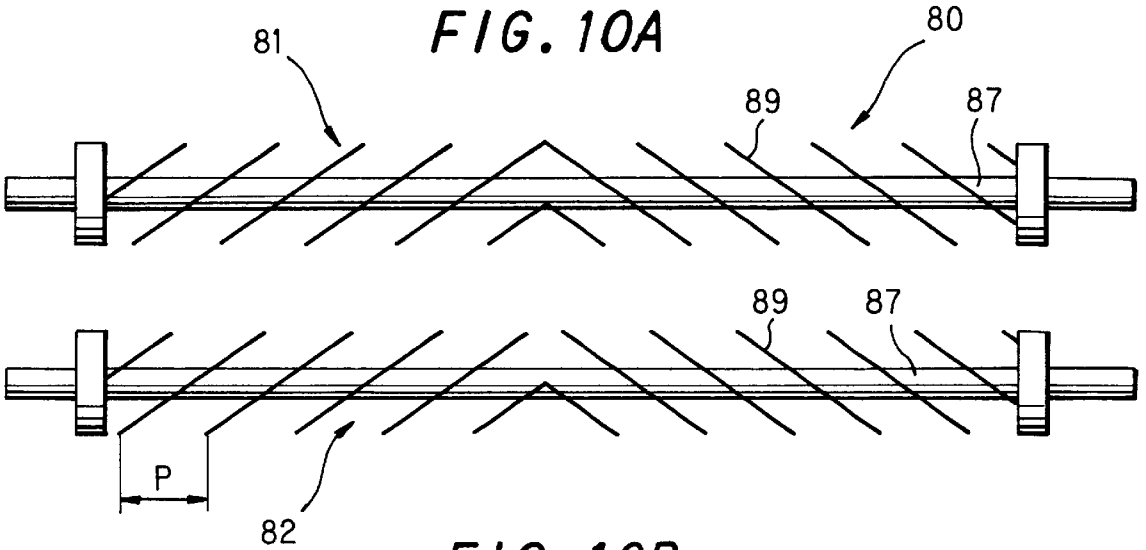
FIG. 10A is a schematic view showing a structure of developer stirring shafts relating to a third embodiment of the present invention.
Figure 10B:
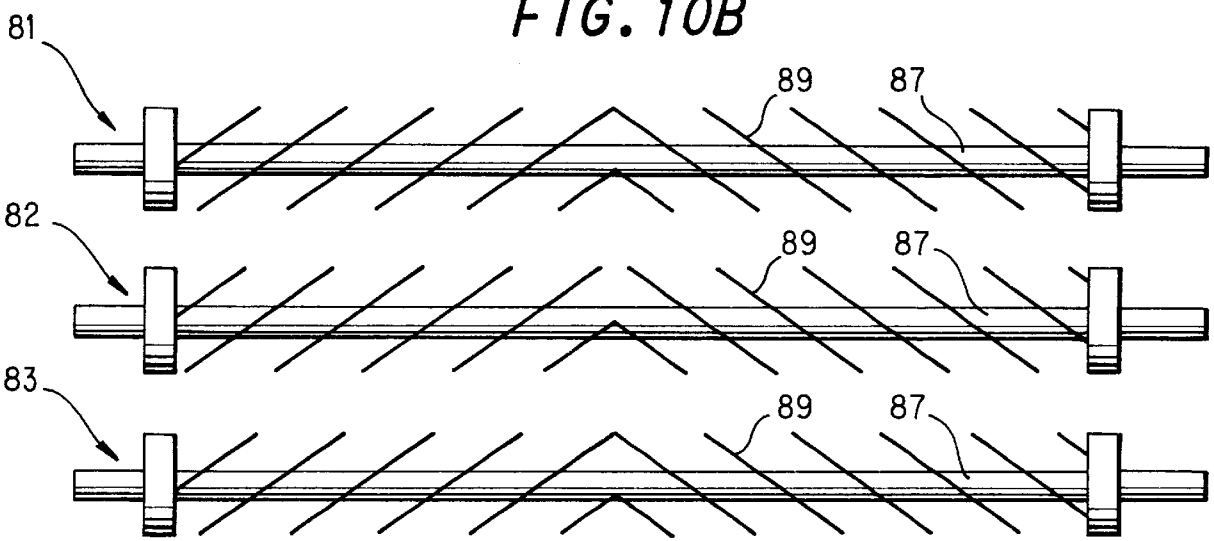
FIG. 10B is a schematic view showing a structure of developer stirring shafts relating to a modification of the third embodiment of the present invention.

FIG. 10A is a schematic view showing a structure having two developer stirring shafts. Each developer stirring shaft is disposed to have stirring vanes symmetrically installed around the center of the developer stirring shaft in the axial direction in slanting toward the center of the developer stirring shaft from both sides of the developer stirring shaft. FIG. 10B is a schematic view showing a structure having three developer stirring shafts. Each developer stirring shaft is disposed to have stirring vanes symmetrically installed around the center of the developer stirring shaft in the axial direction in slanting toward the center of the developer stirring shaft from both sides of the developer stirring shaft.

According to a developing apparatus 80 relating to the third embodiment, two developer stirring shafts 81 and 82 are provided as shown in FIG. 10A. Each of the developer stirring shafts 81 and 82 has stirring vanes 89 disposed symmetrically around a vertical direction with respect to the axial direction, with the center of the developer stirring shaft as a boundary. Between the adjacent developer stirring shafts, the respective stirring vanes 89 are installed in the axial direction by shifting the pitches of the opposing stirring vanes 89 by one-half pitch.

According to this structure, the stirring vanes 89 at one side of the center of the rotational axis 87 are disposed to have reversed inclinations with respect to those of the stirring vanes 89 at the other side of the center, while the size of the inclinations to the rotation axis 87 set all the same. Along with the rotations of the developer stirring shafts 81 and 82, the developer is conveyed from the center of the development casing toward both ends of the casing. Therefore, even when the developer exists at one side within the development casing due to the installation environment of the apparatus or due to a disturbance, maldistribution of the developer is eased, thus it is possible to avoid the unevenness of the distribution of the developer at either left or right sides.

Further, between the adjacent developer stirring shafts 81 and 82, the installation positions of the stirring vanes 89 in the axial direction are different, and the installation pitches are shifted. As a result, it is possible to improve the stabilization and uniformization of stirring and conveying of the developer.

FIG. 10B shows a modification of the third embodiment. According to this modification, three developer stirring shafts are provided. Each developer stirring shaft has stirring vanes disposed symmetrically around a vertical direction with respect to the axial direction, with the center of the developer stirring shaft as a boundary. Between the adjacent developer stirring shafts, the respective stirring vanes are installed in the axial direction by shifting the pitches of the opposing stirring vanes by one-half pitch. The shaft closely disposed to a development roller (not shown) is designated as the first developer stirring shaft 81, then a second developer stirring shaft 82 and a third developer stirring shaft 83 are sequentially disposed in this order.

The first developer stirring shaft 81 and the second developer stirring shaft 82 are structured such that installation pitches of opposing stirring vanes 89 between these developer stirring shafts are shifted by one-half pitch.

The third developer stirring shaft 83 has exactly the same structure as that of the first developer stirring shaft 81. In other words, only the second developer stirring shaft 82 that is disposed between the first developer stirring shaft 81 and the third developer stirring shaft 83 is structured such that the stirring vanes 89 installed on the rotation axis 87 have pitches that are shifted by one-half pitch from the pitches of the first developer stirring shaft 81 and the second developer stirring shaft 83 respectively.

According to this structure, it is possible to obtain effects similar to those of the third embodiment. Further, as the first developer stirring shaft 81 and the third developer stirring shaft 83 have the same shapes, it is possible to use exactly the same materials for these developer stirring shafts. Therefore, this has an advantage in that the productivity is excellent.

Next, a fourth embodiment of the present invention will be explained with reference to the drawings.

Figure 11:
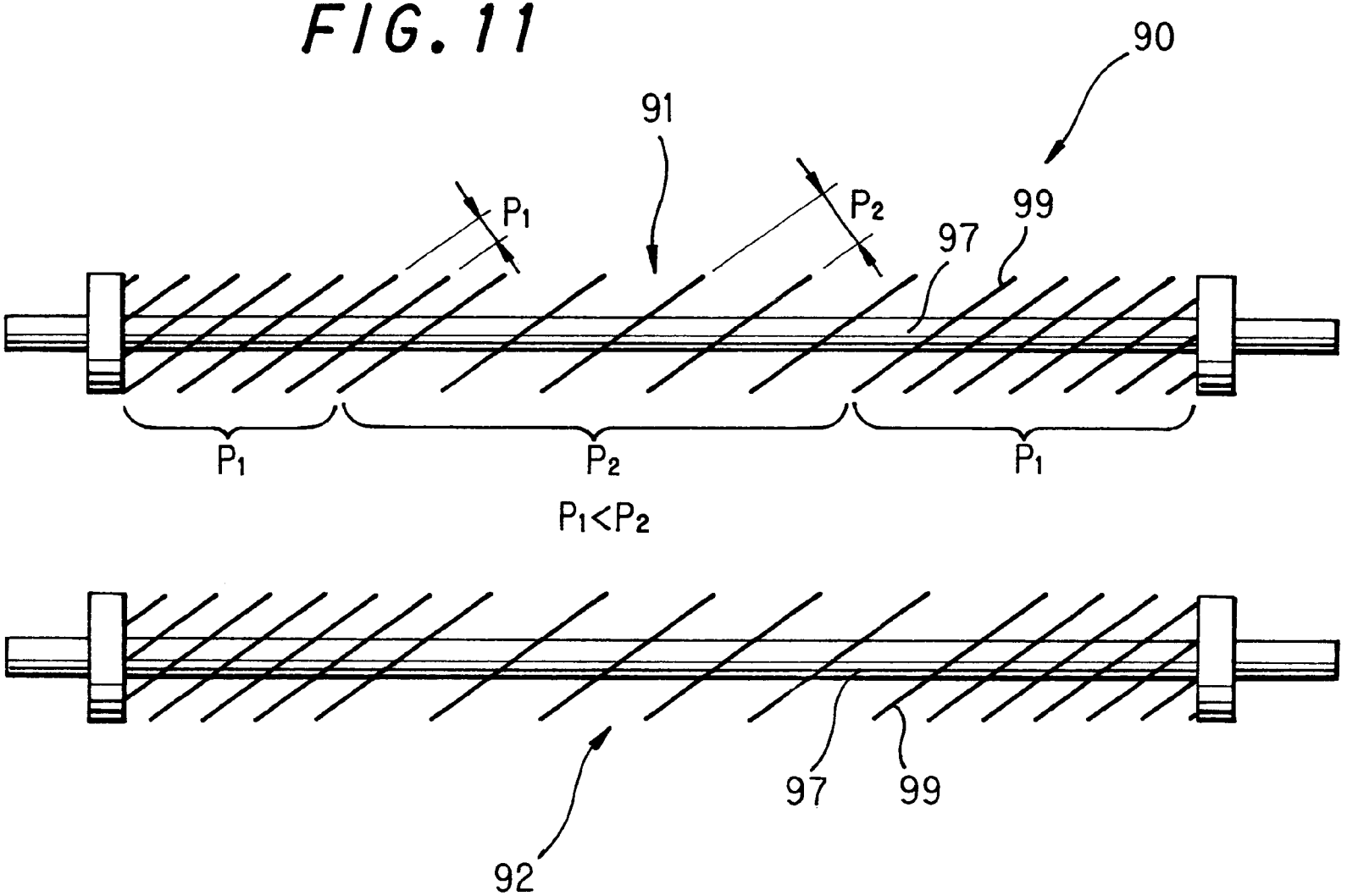
FIG. 11 is a schematic view showing a structure of developer stirring shafts of a fourth embodiment of the present invention.

As shown in FIG. 11, a developing apparatus 90 relating to the fourth embodiment has two developer stirring shafts of a first developer stirring shaft 91 and a second developer stirring shaft 92. In each of the first and second developer stirring shafts 91 and 92, stirring vanes 99 are positioned with gradually decreasing intervals between adjacent stirring vanes starting from the center of the developer stirring shaft as a boundary toward both ends.

The first developer stirring shaft 91 and the second developer stirring shaft 92 are structured such that installation pitches of opposing stirring vanes 99 between these developer stirring shafts are shifted by one-half pitch.

In the stirring vanes 99, an installation interval P1 between the adjacent stirring vanes at both ends of the rotational axis 97 is made smaller than an installation interval P2 between the adjacent stirring vanes at the center of the rotational axis 97.

According to this structure, it is possible to increase retaining ability of the developer at end portions of the developer stirring shafts. Therefore, it is possible to suppress the shifting of the developer to one side within the development casing. Further, as the installation positions of the stirring vanes 99 in the axial direction are altered between the adjacent developer stirring shafts 91 and 92, the pitches of the stirring vanes become shifted. As a result, it is possible to improve the stabilization and uniformization of stirring of the developer.

In the fourth embodiment, the first developer stirring shaft 91 and the second developer stirring shaft 92 are used to stir and convey the developer 2. However, in the present invention, the number of developer stirring shafts is not limited to two, and any plural number is acceptable such as, for example, three or four developer stirring shafts.

The speed of moving the developer by the developer stirring shafts will be explained next.

In the above structure, the developer is stirred and conveyed based on the rotation of the development roller and the developer stirring shafts respectively. It has been known that when the rotational speed of any one of these is low, the developer flow becomes stagnant before that roller.

In the embodiments of the present invention, it is assumed that a difference of moving speeds of the tip portions of the stirring vanes is set to within ±20% between a plurality of developer stirring shafts laid out in parallel. According to experiment conditions to be described later, the difference in moving speeds between the development roller and the first developer stirring shaft is about 12%, and the difference in moving speeds between the first developer stirring shaft and the second developer stirring shaft is about 8%.

Based on this arrangement, it is possible to prevent the stagnant flow of the developer and to improve the efficiency of exchanging of the developer.

The effect of the stirring according to the developing apparatus having two developer stirring shafts relating to, the present invention will be explained with reference to the drawings.

Figure 12:
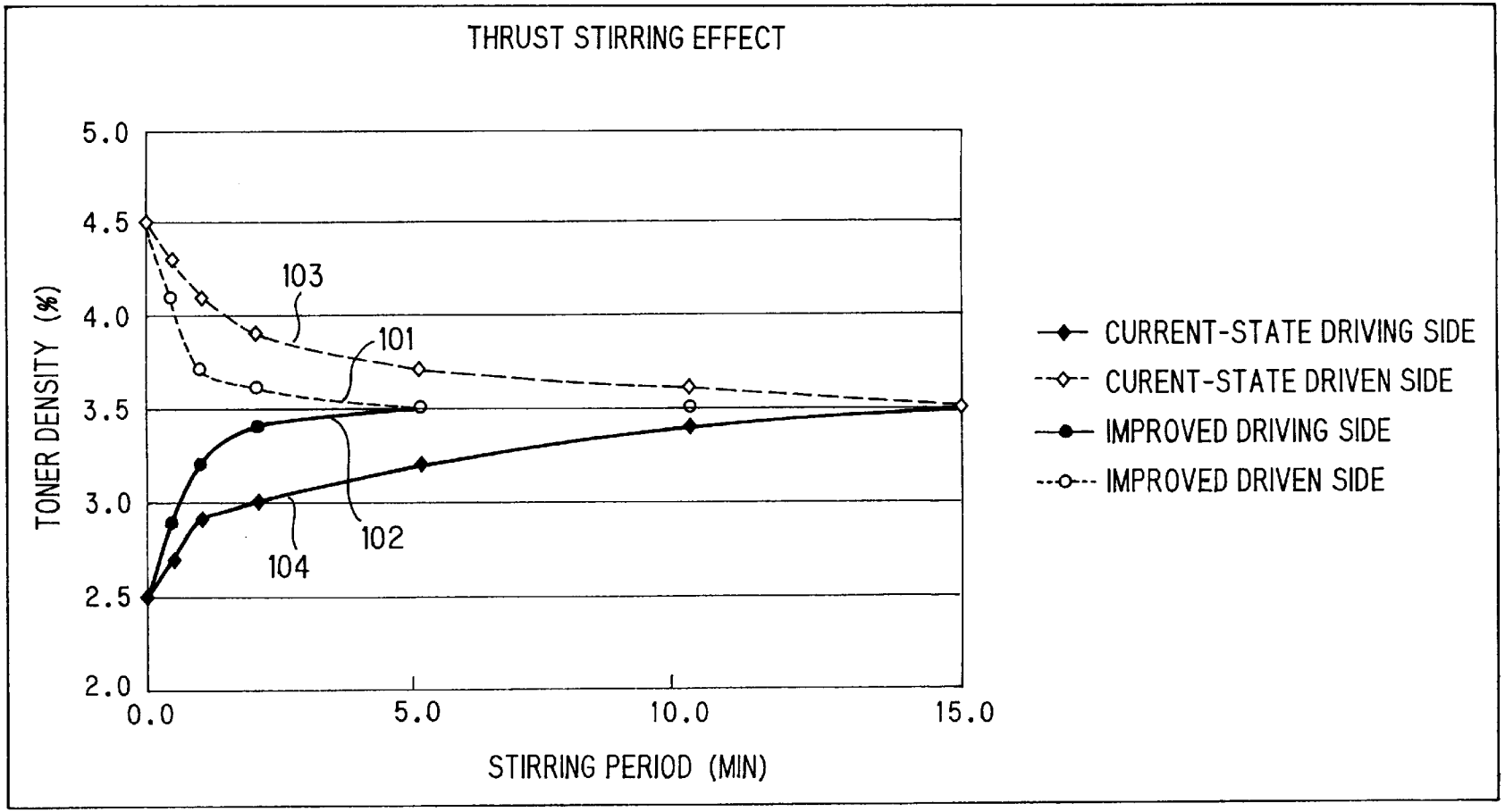
FIG. 12 is a graph showing a comparison of the effect of stirring between the developer stirring shaft of the present invention and the conventional developer stirring shaft.

FIG. 12 is a graph showing a comparison of effect of stirring between the developer stirring shaft of the present invention and the conventional developer stirring shaft. In the developing apparatus equipped with the two developer stirring shafts, two kinds of developers having different toner densities are input from both sides of the driving side and the driven side of the developer stirring shafts within the development casing. Then, the first developer stirring shaft and the second developer stirring shaft are rotated, and the toner densities of the developers near the developer stirring shafts are measured continuously.

It can be understood from the graph that when the structure of the present invention is employed, as indicated by reference numbers 101 and 102, the toner densities come closer to each other immediately after the stirring has started, and the densities become substantially equal within five minutes. On the other hand, when the conventional structure is employed, as indicated by reference numbers 103 and 104, it takes about fifteen minutes before the densities become uniform. Therefore, it can be understood that the structure of the present invention has very high stirring effect as compared to that of the conventional structure.

The followings are the experimental conditions:

Diameter/rotation number of the development roller: 20 mm/200 rpm

Moving speed of the development roller: 209.4 mm/sec. Diameter/number of rotation of the first developer stirring shaft: 22 mm/160 rpm.

Moving speed of the first developer stirring shaft: 184.3 mm/sec.

Diameter/ number of rotation of the second developer stirring shaft: 22 mm/174 rpm.

Moving speed of the second developer stirring shaft: 200.4 mm/sec.

Diameter (short axis) of the elliptic vanes: 22 mm

Shifting of the pitches of the elliptic vanes: 11.5 mm

Array intervals between the elliptic vanes: 23 mm

As explained above, according to the present invention, there is an effect that it is possible to maintain the volume balance of the distribution of the developer in the axial direction within the development casing in a simple structure. Further, there is an effect that it is possible to improve the efficiency of the stirring of the developer without receiving an influence of an inclined disposition of the development casing, and that it is possible to optimize the supply of the developer to a development roller.

What is claimed is:

1. A developing apparatus that is equipped with a development casing that serves as a developing tank by storing developer, a development roller that supplies the developer within the development casing to a developing section, and a plurality of developer stirring shafts that rotate together with the development roller, thereby to stir and convey the developer within the development casing based on the rotation of the developer stirring shafts, wherein the plurality of developer stirring shafts are disposed mutually adjacent to each other and are also disposed substantially in parallel with the development roller, each developer stirring shaft having a rotation axis that rotates together with the development roller and having a plurality of stirring vanes of an approximately elliptic shape laid out at a predetermined angle with respect to the rotational axis, and the stirring vanes are disposed substantially in parallel with each other, with the opposing stirring vanes between the adjacent developer stirring shafts having mutually different installation positions in the axial direction.

2. The developing apparatus according to claim 1, wherein the stirring vanes that are adjacent in the axial direction of the rotation axis are disposed with substantially equal intervals.

3. The developing apparatus according to claim 1, wherein between the adjacently disposed developer stirring shafts, the stirring vanes are installed in the axial directions in such a way that the tip portions of the stirring vanes of one developer stirring shaft face substantially the center positions of gaps formed between the tip portions of the stirring vanes of the other developer stirring shaft.

4. The developing apparatus according to claim 1, wherein between the adjacently disposed developer stirring shafts, the stirring vanes are installed n the axial directions in such a way that the stirring vanes are positioned by sequentially shifting the installation positions by the amount of the distance between the adjacent stirring vanes or the number of the developer stirring shafts.

5. The developing apparatus according to claim 1, wherein developer stirring shafts that are positioned in odd-number rows counted from the development roller are each set to have a number of stirring vanes that is different from the number of stirring vanes of each of developer stirring shafts that are positioned in even-number rows counted from the development roller, and the stirring vanes of the developer stirring shafts that are located at positions in the order of odd numbers of developer stirring shafts counted from the position of the development roller are set to have all the same shapes, and the stirring vanes of the developer stirring shafts that are located at positions in the order of even numbers of developer stirring shafts counted from the position of the development roller are set to have all the same shapes.

6. The developing apparatus according to claim 1, wherein between the plurality of developer stirring shafts laid out in parallel with each other, a difference in the moving speeds of the tip portions of the stirring vane is set to within ±20%.

7. The developing apparatus according to claim 1, wherein in each of the developer stirring shafts, stirring vanes are disposed symmetrically around a vertical direction with respect to an axial direction with the center of the developer stirring shaft is a boundary, and, between the adjacent developer stirring shafts, the installation positions of the stirring vanes in the axial direction are shifted by half pitch each.

8. The developing apparatus according to claim 1, wherein in each of the developer stirring shafts, stirring vanes are positioned with gradually decreasing intervals between adjacent stirring vanes starting from the center of the developer stirring shaft as a boundary toward both ends.

* * * * *